US005355649A

United States Patent [19]

Berridge

[11] Patent Number: 5,355,649

[45] **Date of Patent: * Oct. 18, 1994**

[54] METHOD AND APPARATUS FOR IMPROVED MOISTURE RESISTANT SEAM ASSEMBLY

[76] Inventor: Jack A. Berridge, 1720 Maury, Houston, Tex. 77026

[ * ] Notice: The portion of the term of this patent subsequent to Aug. 4, 2009 has been disclaimed.

[21] Appl. No.: 924,184

[22] Filed: Aug. 3, 1992

Related U.S. Application Data

[63] Continuation-in-part of Ser. No. 668,729, Mar. 13, 1991, Pat. No. 5,134,825, which is a continuation of Ser. No. 431,467, Nov. 3, 1989, abandoned.

[51] Int. Cl.[5] ..... E04B 1/06

[52] U.S. Cl. ..... 52/520; 52/345; 52/588.1; 52/394

[58] Field of Search ..... 52/520, 522, 524, 525, 52/528, 529, 535, 545, 394, 403, 478, 579, 588, 548, 549, 550, 551, 462, 463, 464

[56] References Cited

U.S. PATENT DOCUMENTS

| | | | |
|---|---|---|---|
| 1,723,166 | 8/1929 | Haymas | 52/522 |
| 1,738,578 | 12/1929 | Hayman | 52/522 |
| 2,126,676 | 8/1938 | Thomas | 52/520 |
| 2,128,495 | 8/1938 | Murphy | 52/520 |
| 2,830,546 | 4/1958 | Rippe | 52/522 |
| 3,438,168 | 4/1969 | Tischuk | 52/545 |
| 3,508,368 | 4/1970 | Tischuk et al. | 52/394 |
| 3,969,866 | 7/1976 | Kyne | 52/522 X |
| 3,982,373 | 9/1976 | Wilson et al. | 52/588 |
| 4,269,012 | 5/1981 | Matingly et al. | 52/520 X |
| 4,295,316 | 10/1981 | Carlson | 52/588 |
| 4,570,404 | 2/1986 | Knudson | 52/478 X |
| 4,641,475 | 2/1987 | Berridge | 52/584 |
| 4,700,522 | 10/1987 | Simpson | 52/528 |
| 5,001,881 | 3/1991 | Boyd | 52/520 X |
| 5,134,825 | 8/1992 | Berridge | 52/520 |

OTHER PUBLICATIONS

Berridge Manufacturing Company products catalogue—printed 1990, pp.-all.

*Primary Examiner*—Carl D. Friedman
*Assistant Examiner*—Robert J. Canfield
*Attorney, Agent, or Firm*—Robert C. Shaddox

[57] ABSTRACT

Discussed is a method and apparatus providing moisture resistant seam assemblies for use in inter-connecting building covering panels. The panels provide full-length or, so far as is consistent with thermal expansion, very long panels to eliminate or minimize panel splices. The weather seal or moisture resistant seam runs uninterrupted the length of each panel, and when the panels are assembled, the seam seal isolates inter-connected panels one from another and prevents fluid migration through panel joints.

13 Claims, 5 Drawing Sheets

METHOD AND APPARATUS FOR IMPROVED MOISTURE RESISTANT SEAM ASSEMBLY

This application is a continuation in part of co-pending application Ser. No. 07/668,729, filed Mar. 13, 1991 now U.S. Pat. No. 5,134,825, which was a continuation of Ser. No. 07/431,467, filed Nov. 3, 1989 now abandoned. A related patent by this inventor is U.S. Pat. No. 4,641,475

BACKGROUND OF THE INVENTION

The present invention relates generally to architectural channel shaped weather protection covering products for buildings, particularly surface covering elements for wall and roof sections, and more particularly to weather resistant seams and fastening of adjoining covering elements. Relevant art disclosed and discussed in the referenced previous applications are U.S. Pat. Nos.: 2,047,655 to Forster; 3,438,168 to Tischuk; 3,394,515 to Widdowson; 3,982,373 to Wilson et al; 4,177,615 to Anderson; 4,213,282 to Heckelsberg; 4,267,679 to Thompson; 4,269,012 to Mattingly, et al; 4,495,743 to Ellison et al; 4,570,404 to Knudson; 4,641,475 to Berridge; 4,700,522 to Simpson; 4,759,165 to Getoor et al; 4,987,716 to Boyd; and, 5,001,881 to Boyd. These patents are hereby fully incorporated by reference for all they disclose.

The roofing industry is a highly specialized segment of the building industry. Of primary interest to the industry is the vast inventory of under used commercial buildings waiting to be upgraded and renovated. The fresh look of metal roofing and siding can revitalize both the building and the surrounding area, drawing new businesses, stimulating further growth and creating jobs. Continuous experimentation in research and development has lead to the development, manufacturing and marketing of architectural sheet metal products such as standing seam roofing, curved standing seam roofing, batten seam roofing, soffit panels, facade panels, ceiling panels, Spanish tile roofing, siding panels, metal shingle roofing, light gauge structural members, and light gauge curved structural members. More recently an architectural sheet metal roof system has been developed that creates stepped horizontal lines similar in appearance to the concrete Bermuda roofing used in Bermuda and Florida. Examples of these and other similar applications can be found in Sweet's, a catalog distributed nationally each year by F. W. Dodge Company to all major architectural firms and construction companies. Particularly relevant examples are manufactured by Berridge Manufacturing Company, and are advertised in Sweet's catalog at 07610/BER.

The panels or pans that comprise certain of the elements of the architectural roofing system of the present invention are roll formed from coils of flat metal sheets to custom lengths for application to particular buildings. The roofing products related to the present invention were originally used in the high volume markets for the bright colored roofs for the franchise industry and service stations. From that beginning, research and design has lead to the multiplicity of applications which have spread throughout the building industry to include residential applications and historic restoration building products.

The manufacturing process takes a coil of flat sheet metal and converts that coil into pre-treated, pre-finished, fabricated, high quality architectural sheet metal product by running the sheet metal through a continuous coil coating line, slitting line, cut to length line, roll formers, mechanical and hydraulic press breaks, punch presses, stamping and bending fixtures, and a variety of special dies. The sheet metal coils are available in a variety of coatings, colors, finishes, and alloys. All of the metals and finishes are available in flat sheet and coil for local fabrication if in a particular case that is the more desirable method of construction.

The original standing seam roofing system was a revolutionary design and method of production for custom standing seam roofing. As originally developed the panel or pan had 90° upright legs and was roll formed to custom lengths for particular buildings. The panels were held in place with folding anchor clips attached the roof substrate which allowed the panel to move from thermal expansion and contraction. Snap-on seams were used to splice the panels together and to give the appearance of the old standing roofing, which was folded over in a closed seam by sheet metal mechanics with hand tongs.

The older standing seam roofs were made from sheet instead of coil, and were limited in lengths to 10 foot maximum because that was the length of the forming equipment. The development of the panel standing seam roofing roll formed from coil allowed panels and seams to be fabricated in continuous lengths from eave to ridge and eliminated the horizontal splice of the shorter sheets which was a source for leaks. However, although the continuous length standing seam roofing system eliminated the horizontal splices, and in most cases specified application over solid sheeting and 30 pound felt underlayment, the possibility still existed for leaks to occur through the vertical joints or snap-on seams from blowing rain, syphoning, or flooding over the seam. Therefore, even though the unnecessary horizontal seams were eliminated it was possible for water to reach the felt underlayment, and it was further possible if the underlayment was not properly installed or had holes that water could enter the building. These types of leaks could only be discovered after they developed and repairs and replacements in the field had to be performed. Repair of roofing leaks can be time consuming and expensive because it is difficult to locate the exact source of the leak. The water can be syphoned through, or leak through at one point, but then it will travel along the felt or along the underside of the roofing materials and can enter at the building at a completely different location. It is far easier to design and install a leak proof seam, than to locate and repair a leak once it develops.

Prior art solutions to the leakage problems included application of caulking compounds in the top of the seams, and application of a hot melt compound in the top of snap-on seams during the roll form operation. Neither of these solutions was successful. The compound was interrupted at each anchor clip which still allowed water to overflow and to reach the felt underlayment. Although these solutions are unsatisfactory, many roofing companies are still using them.

The inventor of the present application, in an effort to solve the leak problems on standing seam roofs, redesigned anchor clips with shorter pre-folded legs to allow one upright leg of a roofing panel to be rotated into place under the folded leg of the anchor clip. The shorter legs of the anchor clip then allowed a gasket of some material to have room enough to seal itself against the upright leg of the roof panel below the anchor clip to form a moisture resistant splice of panels and seams completely uninterrupted by the anchor clips. The materials and particular extruded shape for the gasket material in combination with the anchor clips and roofing panel legs is described and claimed in the related patent application, U.S. Pat. No. 4,641,475 by inventor Jack Berridge.

The gasket and snap-on seam cover splice is manufactured in a roll-former which is built to roll form a snap-on seam and insert a vinyl extrusion at the seam at the same time. The vinyl insert is fed into the snap-on seam from a coiled extruded shape approximately mid way through the roll-former, and the metal is closed around it and cut to length in the snap-on seam on cutting equipment. This snap-on tee panel standing seam system has been found to be completely water tight regardless of the amount and direction of water flow. This is a break through for a moisture resistant metal standing seam product.

Although the tee panel standing seam leakage problem was successfully solved by the invention embodied in U.S. Pat. No. 4,641,475 there exist other applications for metal panel weather protection elements where structural or architectural design requirements are not satisfactorily handled by the tee panels and snap-on seam covers. For example, certain applications require the metal pan roofing panel to carry a structural load rather than to merely provide a weather proof covering. These structural requirements lead to the development of the zee lock structural standing seam roof panel and the new and improved horizontal Bermuda roof panel and seam seal. The present invention further provides a moisture resistant sealing element and method specifically for use with the zee panel shape and Bermuda roof panel, as will be described in greater detail below.

SUMMARY OF THE INVENTION

The present invention relates to a new and improved method and apparatus for weather proofing building exteriors comprising elongated, adjoining flanges which in some embodiments are field crimped to fold one panel's flange over the flange of an adjacent panel and in other embodiments are preformed to carry a seal, which is attached to a first edge or lip along one side of each panel, for enclosure within a receptacle pocket of an adjacent panel, where each receptacle pocket is formed along the opposite or second side of each panel from the lip at the first edge when the panels are installed upon a building adjacent to one another. All embodiments thus form an elongate seam including a seal member adapted to be used in sealable engagement with and between adjoining panels for preventing fluid migration between the panels.

The invention comprises elongate channel shaped members formed into panels or pans from continuous rolls of flat metal. Each of the panels is identical in cross-section to other panels and the panels are formed in custom cut lengths so that when used as facade or roofing coverings there are only horizontal seams since there is no need to adjoin elements of shorter length to span the roof, facade or wall. Other elements optionally used in combination with the panel shaped pans are either continuous ribs, or clips. The clips or continuous ribs are fastened directly to the structure either to the joists and purlins or solid sheathing, whichever is used on a roof. Continuous ribs and rib bearing plates may be used where additional structural strength requirements are present, as will be further explained below. Also optionally used with the panels of the present invention is an extruded elastomeric weather proofing sealing member. In the Bermuda panel embodiment, the sealing member is enclosed within a receptacle pocket provided in the panel shape. This elastomeric sealing member may be attached to the male leg or lip along one edge of each panel from spools during the roll forming of the panel shape for Bermuda panels and may be retained upon the lip by piercing and offsetting the leg to hold the specially designed protrusions of the sealing member.

Each roofing panel presents an identical and asymmetrical profile. One embodiment, the zee panel, viewed in profile, presents a first edge of the roofing panel with a vertical upward extension of the panel for a short distance, a first "standing plane" and then a right angle formed in the panel so that a horizontal element of the panel is formed which extends back over the panel towards the center or interior of the panel a first "extending plane". The opposite, second edge of a given roofing panel viewed in profile, has a similar upward vertical extension of the panel a second "standing plane" to a height slightly above the vertical extension at the opposite side of the panel and this second edge of the panel then has a horizontal extension of the panel in the same direction as the horizontal extension at the opposite side of the panel so that this second horizontal extension a second "extending plane" extends away from the interior of the panel, for a distance slightly greater than the horizontal extension or first "extending plane" at the first edge of the panel. At the second edge, the roof panel has a further extended element, a "dropping plane" extended in a downward vertical direction for a distance which may be approximately equal to the horizontal extension at the second edge of the panel.

After the "zee" clips or continuous "zee" ribs have been installed the roofing panels are put in place. A zee panel is lowered onto the roof and rotated into position so that the first edge of the roofing panel, with the horizontal extension extending over the panel, is fitted underneath the vertical extension of the series of "zee" clips or the vertical extension to the continuous "zee" rib. At this time, is so desired, an elastomeric sealing member comprising a generally U shaped extruded strip can be installed, by slipping the strip over the overlapping horizontal extensions. This strip can be supplied in a roll or from a reel of the extruded material so that it can be cut to the precise length desired which corresponds to the total length of the roofing panels. The preferred embodiment utilizes vinyl for the sealing strip. The vinyl sealing strip is U shaped so that it can be installed or slipped over the horizontal extensions of both a roofing panel and the horizontal extension at the top of a continuous "zee" rib or a "zee" clip. This sealing strip is installed in the field by hand by simply slipping it over the two edges of an adjoining roof panel and "zee" clip or "zee" rib. The tips of the U of the U shaped sealing member may be configured so as to flair outwardly and additional rims or ridges may be formed at the exterior and along the length of the vinyl strip to enhance the weather sealing ability of the vinyl strip.

After the weather sealing vinyl strip has been installed, if one is required or desirable, a second roofing panel is put into position so that its first edge is installed at the next continuous "zee" clip. This panel is then rotated into position so that the second edge of the second panel will fit over the combination of the first edge of the first roofing panel, the "zee" clip or "zee" rib, and the vinyl seal. The second edge of this second roofing panel will overlay this combination and the short downward vertical projection or dropping plane extending away from the center or interior of the panel at the second edge of this second roofing panel can then be folded over in the field by any suitable means and crimped or clamped into position so as to enclose the combination of weather seal, the first edge of the first installed roofing panel, and the upper horizontal projection of a continuous "zee" rib or "zee" clip. The installation of succeeding panels is continued in a similar manner to form an interlocked weather proof moisture resistant covering.

As with the zee panels each panel of the Bermuda panel system presents an identical and asymmetrical profile. One edge of each panel is provided with a male leg or lip which is directed or pointed relatively back toward the center of that panel. The opposite side or edge of the panel is provided with a receptacle pocket or female joint, the aperture of which is also pointed or directed back toward the center of the panel. The interlock of the two panels is thus a simple male-female joint. However, a continuous elastomeric formed strip may be applied to the lip or male leg by piercing and offsetting the male metal leg to hold the specially designed formed strip. The male leg with the formed sealing strip attached is inserted into the female joint in the field to provide an interlock assembly that prohibits air and water infiltration. The Bermuda panel is fabricated on a roll former and the formed sealing strip may be applied to the panel from spools attached to the roll former during fabrication, whether that takes place in the shop or the field.

The Bermuda panels are installed from eave to ridge in sequence, by using clips or fasteners to hold the first edge of the first panel to the building or substrate and then clipping the second edge of the first panel to the building, interlocking the first edge of the second panel to the second edge of the first panel, clipping the second edge of the second panel and proceeding thus et seq to completely cover the building.

BRIEF DESCRIPTION OF THE DRAWINGS

The foregoing features and other below described aspects of the invention will be explained in greater detail when the following description is read and taken into conjunction with the accompanying drawings of which FIGS. 1 through 6 refer more particularly to the prior co-pending parent application, Ser. No. 688,729, which issued as U.S. Pat. No. 5,134,825, wherein.

DETAILED DESCRIPTION OF PREFERRED EMBODIMENTS

Figure 1:
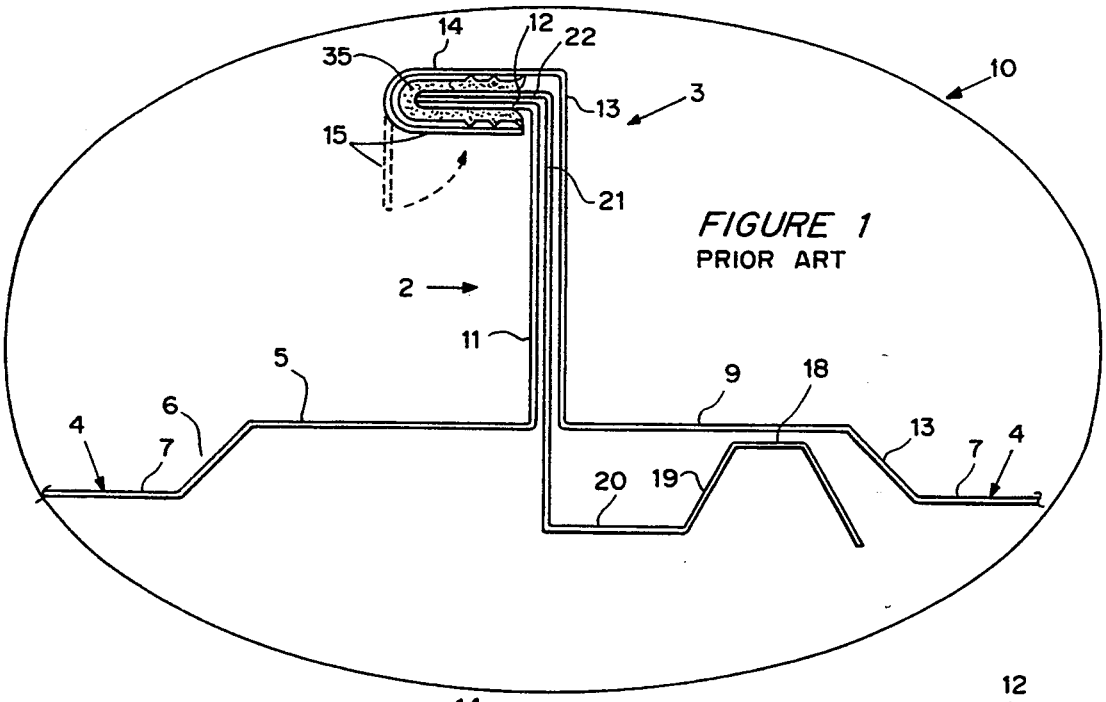
FIGURE 1 PRIOR ART
FIG. 1 is a profile of the moisture resistant seam assembly.

With reference now to the drawings, the new and improved method and apparatus presented by the present invention will now be described.

The present invention relates to a new and improved structural building covering system embodying and incorporating a moisture resistant seam assembly designated generally in the drawings by the numbers 10 and 10*a*. A great improvement over the prior art structural roofing assemblies and over prior art weather proof seams can best be appreciated when one considers that although there are structural roofing systems present in the prior art, and although there are methods of weather proofing longitudinal seams, as best exemplified by U.S. Pat. No. 4,641,475, (hereby fully incorporated herein), until the present invention there was no method or apparatus providing a moisture resistant seam assembly for a multi-component structural roofing assembly formed from prefabricated sheets of metal which could provide the ability to withstand structural loading in the magnitudes the present system is capable of withstanding or which could comply both with strict architectural design requirements and be both completely air tight and water tight.

Although there were prior art roofing assemblies which presented a flange or edge of one roofing panel which could be folded over, for instance by tongs, to crimp or clamp upon an adjacent assembly, until the present invention there was no effective means of sealing the joints and the seam subject to allowing moisture travel through the seam which could lead to leaking roofs. Also, although, as exemplified by U.S. Pat. No. 4,641,475, the prior art does present apparatus for sealing elongate roofing seams between adjacent preformed metal panels, the clip-on seam sealing means provided by the prior art is merely a means of weather proofing and moisture sealing, and does not provide any significant structural aspects and in fact the effectiveness of the seal can be lost if the panels are subjected to structural loadings in excess of design loadings.

As will be further described in much greater detail, the present invention provides a system of components for assembly which provides for structural strength of varying amounts as desired and appearances to meet specific design requirements and which further is capable of providing a weather resistant moisture proof seam at the junction of adjacent roofing panels. It is to be further understood that although the following and parts of the previous discussion have referred specifically to roofing panels and elements for sealing a roof, that the present method and apparatus is equally applicable to facade panels for use in parapets, or any other part of the building throughout a range of vertical to horizontal applications.

Roofing panels of the present invention, as illustrated, are prefabricated from coils of flat sheet metal. The coils are mounted on a continuous line which includes continuous coil coating equipment, shitting equipment, cut to length equipment, roll formers, mechanical and hydraulic press breaks, punch presses, stamping and bending fixtures, and a variety of special dies. In this manner panels of any desired length can be custom manufactured for any particular building. Portable roll forming equipment allows precision custom cut to length panels to be formed on site and thus can eliminate waste and delays caused by waiting for replacement materials needed because of transit or storage damage or panel misfits.

The metal panels can be manufactured from pre-finished metal of a variety of different alloys including, by way of example and not by way of limitation, galvanized steel or sheet steel having a coating of aluminum zinc alloy such as GALVALUME, a trade name for a patented steel sheet product manufactured by Bethlehem Steel. The bare noncoated galvanized steel can be G-90 galvanized steel, the galvanized steel is most economical, but where a superior atmospheric corrosion resistance is needed an architect may specify pre-finished GALVALUME. The GALVALUME when pre-finished with KYNAR 500 is a guaranteed 20 year metal coated with a guaranteed 20 finish. Other coatings can be applied to the sheet metal at the factory as apart of the continuous coil coating line to pretreat the metal, apply a primer coat, apply a finish coat, and also apply a liquid strippible protective coating. A strippible plastic film can be applied to the painted surface for protection during fabrication and shipment and removed before the field installation. The previously mentioned KYNAR 500 resin coating is a premium fluorocarbon coating achieved by applying a resin produced by the Pennwalt Corp. This coating extends the exterior durability due to outstanding resistance to ultraviolet radiation. Other finishes and coatings can be achieved such as copper coating and an aged appearing copper coating, which can be achieved by powdering pure copper and then suspending the powdered copper permanently in a clear fluorocarbon resin, and applying that mixture to hot dipped galvanized steel or GALVALUME over a urethane modified primer. The aged appearance can be achieved by applying an antiqued fluorocarboned patina over a copper coat in a random pattern to give the appearance of a partially weathered copper. Best results in the finishes are achieved with the KYNAR 500 fluorocarbon coating applied to the manufactured metal pans with a top side dry film thickness of from 0.70 to 0.90 mils over a 0.25 to 0.35 mil prime coat to provide a total dry film thickness of 0.95 to 1.25 mils. The bottom sides in general are coated with the primer with a dry film thickness of 0.25 mils. Any color or pigmentation desired can be achieved by pigmenting the coatings by means well known in the art. In general, the sheet utilized on the manufacturing line for the panels, clips, and ribs is 24 gauge sheet metal, although the present invention is not to be considered as so limited.

Figure 2:
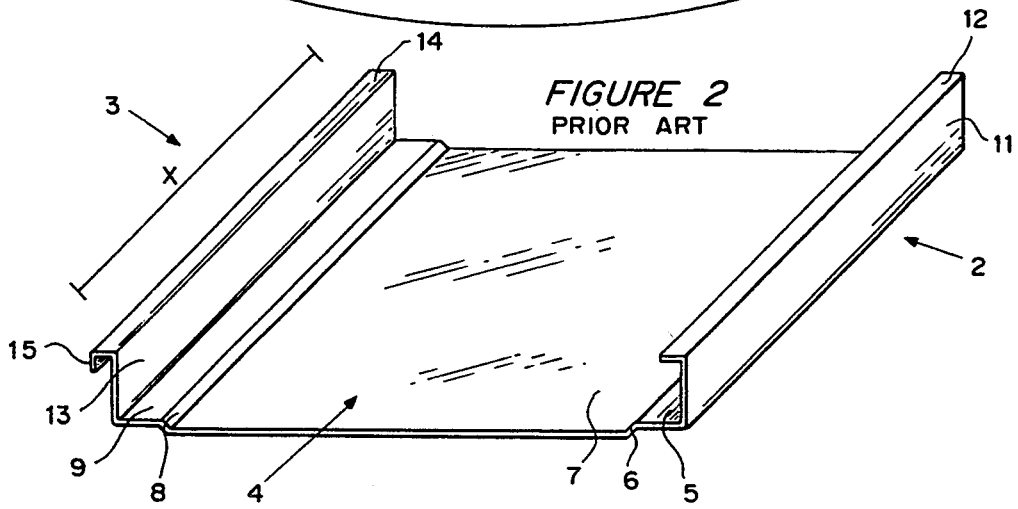
FIGURE 2 PRIOR ART
FIG. 2 is a single roofing panel shown in perspective view.
Figure 3:
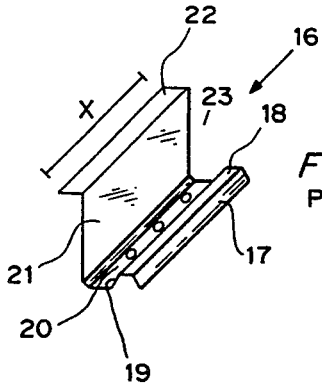
FIGURE 3 PRIOR ART
FIG. 3 is a single "zee" clip component shown in perspective view.

Referring now particularly to FIG. 2 an individual manufactured building covering zee panel in accordance with one embodiment of the present invention will be described in greater detail. As illustrated by the front edge profile which can be clearly seen in FIG. 2, building covering panels in accordance with the present invention are generally asymmetrical as can be seen by comparing the first side indicated generally by reference numeral 2 to the second side indicated generally by reference numeral 3. As has been previously described, the roofing panels are manufactured from continuous coils of flat metal, and therefore they can be premanufactured to any length desired. The length of the panel illustrated in FIG. 2 is therefore indicated by the dimension or parameter X. Similarly as will be further described, other components of the apparatus and method of the present invention as depicted in FIG. 3 also can be manufactured to any length desired, and therefore the length is indicated in FIG. 3 by the reference numeral X also.

Referring again to FIG. 2 it can be seen that the bottom of the panel 4 has been shaped so as to comprise five definite elements or planes, each joined to the adjacent plane or planes by a dyhedral angle so that the longitudinal axes of all planes, in the X direction designated, are parallel. Beginning at the first side of the panel 2 and moving from right to left across the bottom of the panel 4 these planes are designated in the drawings by numerals 5, 6, 7, 8 and 9. For purposes of this description, these five planes will be designated as the right plane 5, the right-angled plane 6, the bottom plane 7, the left-angled plane 8, and the left plane 9. In general the angle illustrated between any two adjacent planes is illustrated as a 45° angle, however, it should be understood that is simply for the purposes of illustration and the present invention is not to be understood as being limited a panel with a bottom comprising five planes, and further is not to be understood as limited to a panel wherein the planes comprising the bottom are connected a 45° angle relative one to another. The purpose of including multiple planes joined at angles is to enhance the structural strength carrying capabilities of the panel, and therefore the panel can be configured to include as many planes as desired, and further the planes can be connected at angles calculated by standard engineering principles to best carry structural load for any given particular installation.

Still referring to FIG. 2 it can be seen that the first side 2 of a building covering panel comprises two additional elements on planes 11 and 12 where plane 11 extends vertically upwardly at a right angle from plane 5, and wherein a first extending plane 12 in general is aligned all the planes 5 through 9 also, but extends horizontally back toward the center or interior of the panel 4 at a right angle relative to plane 11. For the purposes of discussion, these two planes at the first side 2 of the building covering panel will be referred to as the right vertical plane or first standing plane 11, and the right horizontal plane or first extending 12.

Again referring to FIG. 2, but to the second side 3 of the panel, this side of the panel unlike side 2 comprises three additional elements or planes rather than two. These three planes are here referred to as planes 13, 14, and 15, and will be designated respectively as the left vertical plane or second standing plane 13, the left horizontal plane or second extending plane 14, and the left short vertical plane or dropping plane 15. The asymmetrical nature of the building covering panels of the present invention can now be clearly described in that it is apparent that from the right vertical plane down to the combination of the contiguously joined elements or planes comprising the bottom panel 4, elements 5, 6, 7, 8 and 9, and including the left vertical plane 13, the bottom of any given building panel consistent with the present invention is substantially symmetrical. However, the horizontal plane 12 and 14 as illustrated in FIG. 2 both extend to the left from their attachment point to their respective vertical planes 11 and 13. Further, the left horizontal plane or second extending plane 14 has an additional plane 15 attached or formed contiguously with it. Therefore, when viewed in profile as the front edge of FIG. 2 illustrates, it can be readily seen that the right horizontal plane or first extending plane 12 extends back over the bottom planes toward the center or interior of the bottom plane 4 in contrast to the left horizontal plane or second extending plane 14 which extends away form the center or interior of the bottom plane 4.

When viewing the roofing panels in profile it is apparent that the designation "zee" refers to that the fact that in profile, particularly the second side 3 of a building covering panel resembles the letter "zee" of the alphabet. Further functions of these just described features of asymmetry and the zee profile will be described in greater detail below. By using "zee" clips of predetermined length and locating the clips at specific locations, it is possible to further refine a buildings structural design, by purring the structural capability only where it is required.

Referring now to FIG. 3 there is illustrated a second component of the apparatus of the building covering system of the present invention. FIG. 3 illustrates a bracket or "zee" clip, or a continuous "zee" rib, depending upon the length chosen for the dimension X. It can be appreciated that by extending a bracket "zee" clip continuously along the length of a panel, one arrives at a continuous "zee" rib, and it can be further appreciated that by so extending the "zee" clip to form a continuous "zee" rib, much greater structural strength will result when the "zee" rib is combined into the complete apparatus of the present invention as will also be described in greater detail below.

Keeping in mind that the dimension X can be adjusted as desired to extend for the entire length of a building covering panel such as is illustrated in FIG. 2, or if less structural strength is desired, instead of using a continuous bracket or rib a choice of a shorter dimension X will lead to a clip which can be used in combination with other clips installed in a series at intervals along the panels. Numeral 16 refers generally to the bracket, "zee" clip or continuous "zee" rib. Elements of either the bracket "zee" clip or "zee" rib will now be described with the understanding that the difference between a "zee" clip or "zee" rib is the dimension X.

Referring to FIG. 3 it can be seen that similar to the building covering panel illustrated in FIG. 2, a bracket "zee" clip or "zee" rib 16 can be stamped or otherwise formed from a flat piece of metal sheeting, and the bracket "zee" clip or "zee" rib 16 comprises a plurality of flat planes or elements contiguously joined so that the longitudinal axes of all planes in the X direction are parallel. The "zee" clip 16 illustrated in FIG. 3 comprises six planes here referred to as the right angled plane 17, the right horizontal plane 18, the central angled plane 19, the bottom plane or first bracket surface 20, the vertical plane or standing bracket surface 21, and the top horizontal plane or extending bracket surface 42. Also, illustrated in FIG. 3 are openings 23 which may be optionally formed along the bottom plane or first bracket surface 20 for use with various fastening devices which are well known to those in the art.

Figure 4:
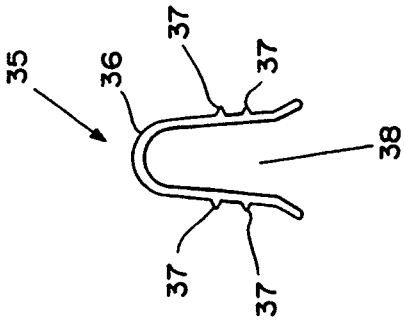
FIGURE 4 PRIOR ART
FIG. 4 is an elevational sectional view of the elongate elastomeric sealing member of the present invention.

Referring now to FIG. 4 there is illustrated the remaining component element of the first embodiment of the improved method and apparatus for moisture resistant seam assembly of the present invention. FIG. 4 illustrates a seal means 35. FIG. 4 illustrates in cross-section the seal means which is illustrated in perspective view in FIG. 6. Referring to FIG. 4, the seal means 35 includes a main body section 36 and a plurality of elongate pliant figures, ridges, or flats 37. As can be seen by referring to the cross-section of FIG. 4 the elongate sealing means in cross-section is U shape, and the pliant fingers, flats or ridges are formed along the length of the exterior of the U. The interior of the U indicated by 38 is generally substantially smooth, and is sized so that it will easily slip over the combined thickness of the right horizontal plane at the first side 2 of a building panel as indicated in FIG. 2 when said right horizontal plane 12 is laying closely adjacent the top horizontal plane 22 of the "zee" clip or "zee" rib 16 illustrated in FIG. 3 during the installation of the building roofing system of the present invention as will shortly be described in greater detail. Preferably the seal member 35 terminates at the two ends of the U in outwardly flaring end tips 39.

Figure 6:
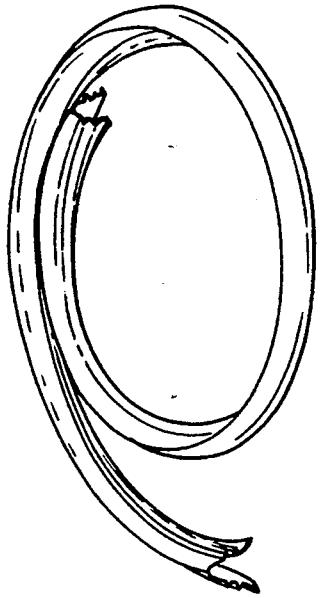
FIGURE 6 PRIOR ART

As mentioned, the seal member 35 includes a plurality of pliant fingers, flaps or ridges designated generally as 37, formed generally with and/or extending from the exterior surface of the seal member 35. Preferably the fingers or ridges 37 are substantially horizontally aligned to one another, although fingers on one side of the U may be offset from fingers on the other side of the U. Preferably the seal member 35 is formed out of any suitable sealing material, however in practice it is preferred that the seal member 35 be formed of an extruded vinyl material, so that the body section 36, and pliant fingers 37 are formed in a continuous elongate manner, so that the seal can be supplied in a continuous roll or coil of sealing material which can then be cut to the desired length. Such a coil or roll of the seal material is illustrated in FIG. 6.

Figure 7:
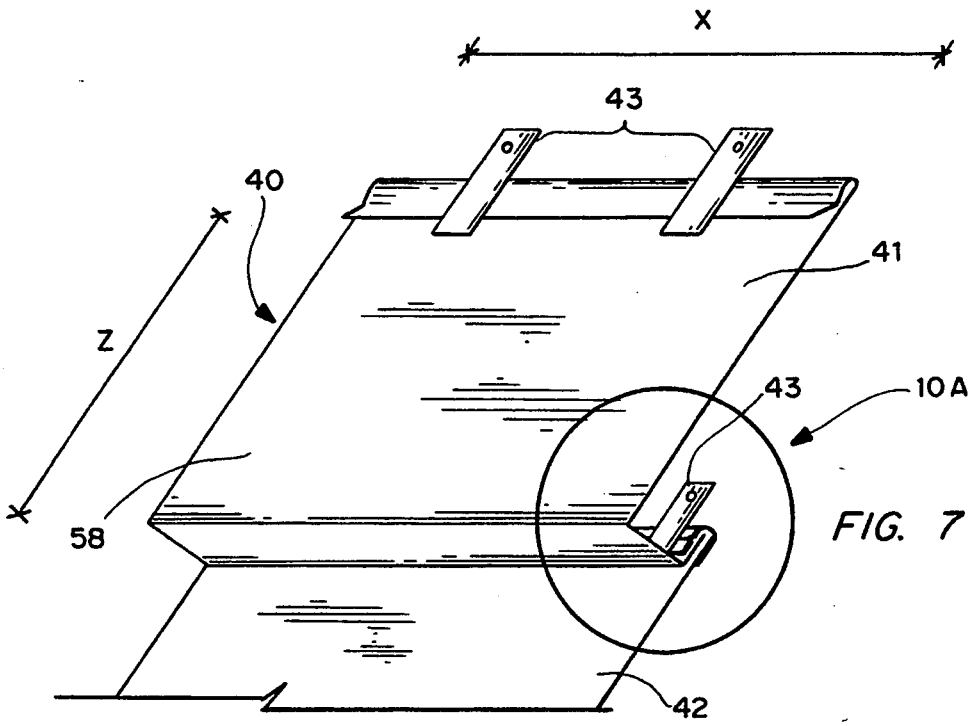
FIG. 7 is a perspective view of the interlocked Bermuda panels and fastening clips.

Referring now to FIGS. 7–12 and more particularly to FIG. 7 the panels of the second embodiment, the Bermuda panels 40 will be described in greater detail. The perspective view of two individual interlocked panels 41 and 42 is shown in the referenced figure. Also shown in the figure are the male-female interlocking joint 10*a* and several anchor clips 43. As illustrated also in the following figure FIG. 8 the edge profile, the Bermuda panels 40 are generally asymmetrical when comparing a first side 44 to the second side 45. As previously described the panels are manufactured from continuous coils and may be fashioned to any length as required. The length of the Bermuda panels is therefore indicated by the dimension or parameter X the same as for the zee panels.

Referring again to FIG. 8 is can be seen that the panel 40 has been formed so that at the first edge 44 there is a return and an extending male leg or lip 46 that projects or is directed generally back toward the interior pane 58 of the panel. The second, opposite side or edge of the panel 45 in contrast to the first 44 is formed into a receptacle pocket or female joint component 47 with a flared lip segment 59.

Figure 8:
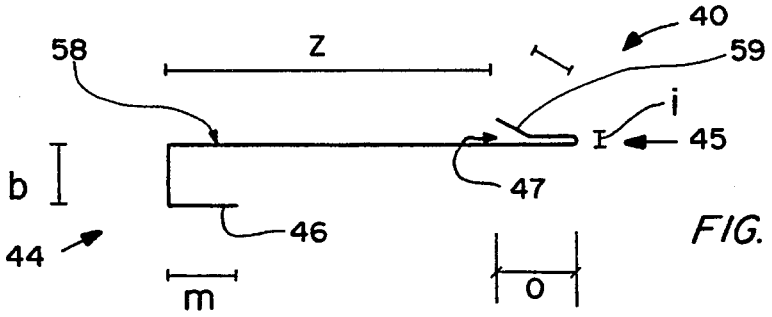
FIG. 8 is a profile of the Bermuda roof panel product.
Figure 8A:
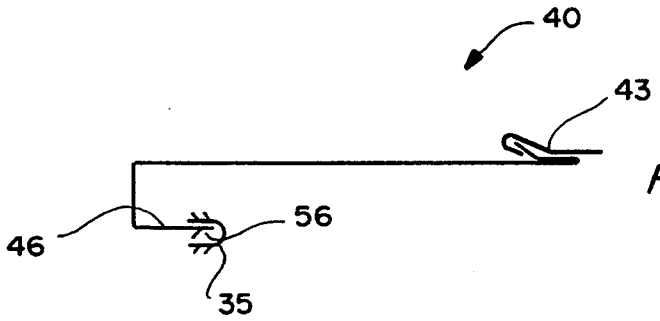
FIG. 8A is a profile of the Bermuda roof panel product and attached seam seal element.
Figure 9:
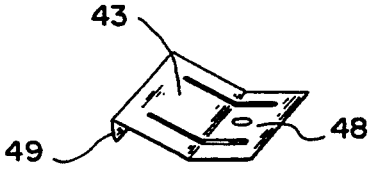
FIG. 9 is a perspective view of one embodiment of a retaining clip.
Figure 10:
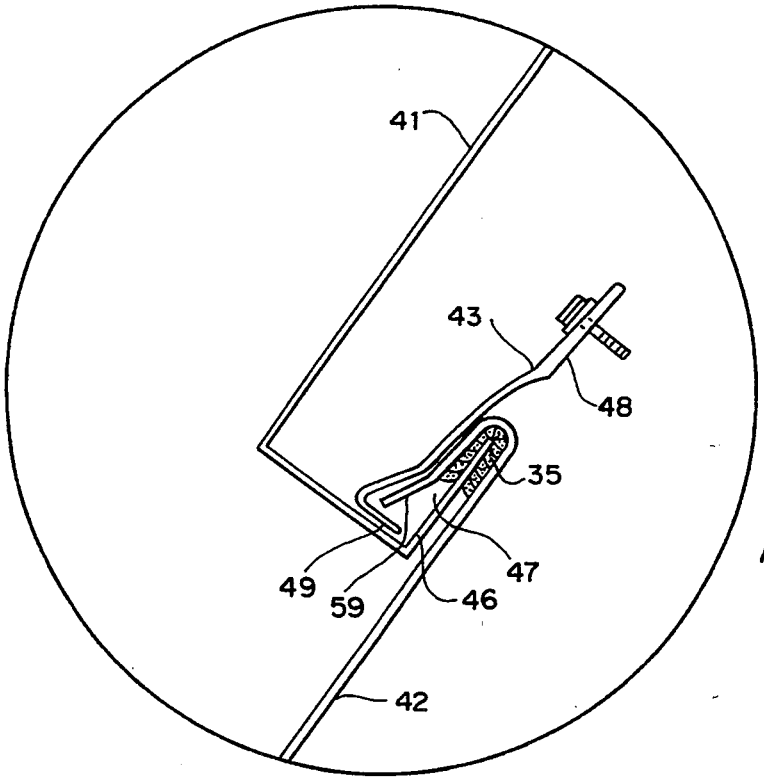
FIG. 10 is an expanded view of the interlocking joint between panels.

FIGS. 8*a* 9 and 10 detail the anchor clip component 43 of the Bermuda panel embodiment of the present invention. The clips 43 are formed to present a surface 48 that is fastened against the building, or substrate if one is used, and at the opposite side of the clip to provide a flange or lip 49 that is configured to fit over the flared lip segment 5 of the receptacle pocket 47 at the second edge of a panel, to interlock with the edge of the panel 45 and hold it securely against the building. Flange 49 is also configured to allow clearance for insertion of the male leg or lip 46 of the first edge 44 of a panel 40 into the receptacle pocket or female joint component 47. This feature is best illustrated in the enlarged FIG. 10.

Referring now to FIGS. 4, 6, 8*a*, 10, 13 and 14 there is illustrated the remaining component of the Bermuda panel embodiment of the present invention, the seal means 35. The same reference numeral 35 is used for the sealing means of both panels and it is envisioned that similar configuration and elastomeric components can be used in both embodiments. The specific descriptive text set out earlier for the zee panel seal means is hereby incorporated by reference for the seal means utilized with the Bermuda panels.

Figure 11:
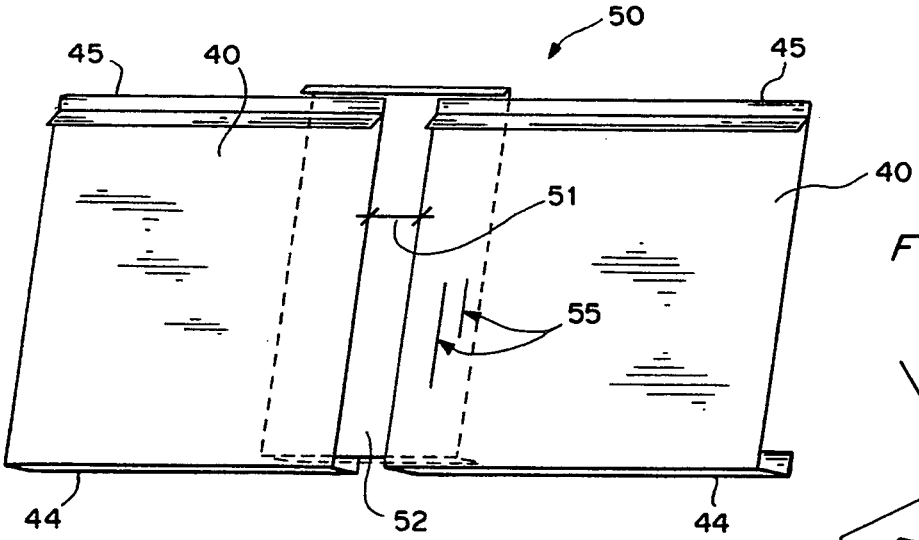
FIG. 11 is a view of an expansion plate or longitudinal splice between panels.
Figure 12:
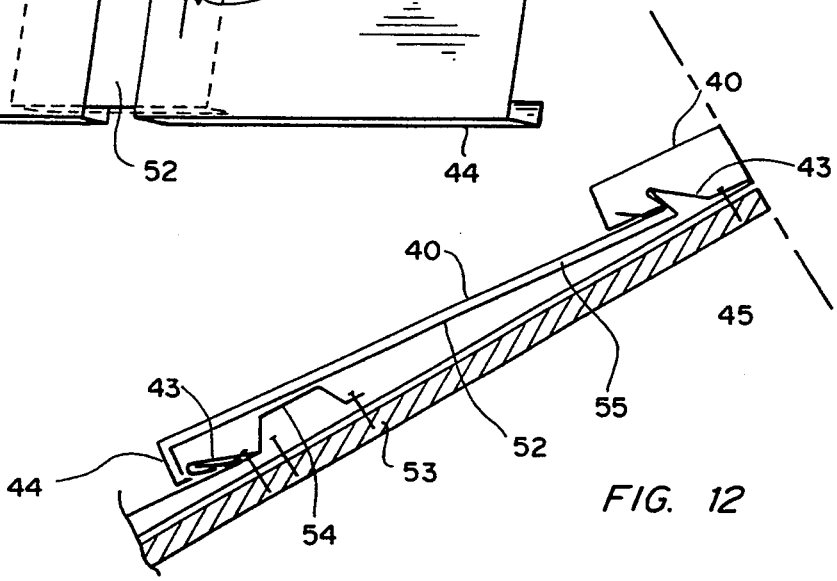
FIG. 12 is a cross section of panels and a longitudinal splice installed upon a substrate.
Figure 13:
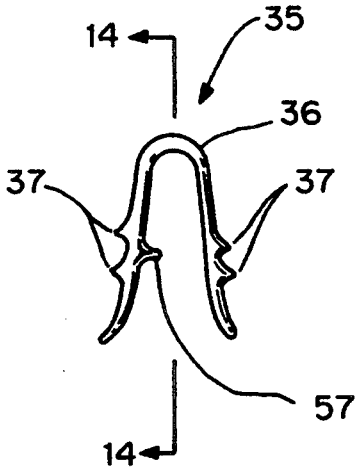
FIG. 13 is an end view of an alternative embodiment of the elastomeric sealing member of the present invention.
Figure 14:
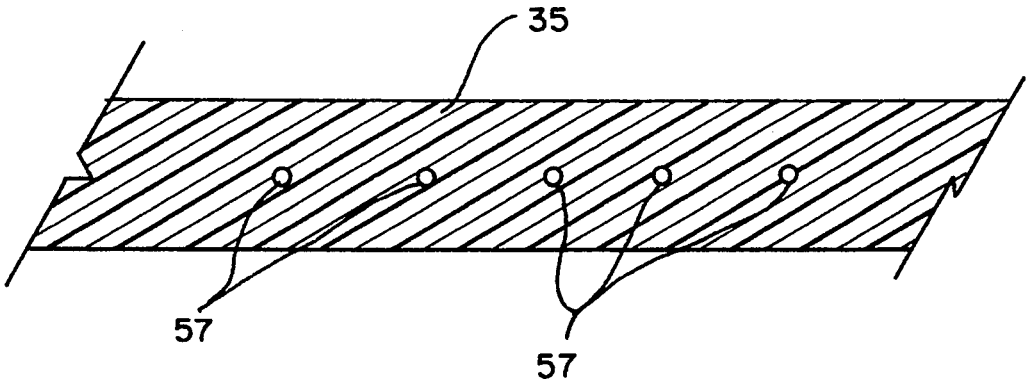
FIG. 14 is a cross section through the sealing member of FIG. 13.

Referring now to FIGS. 11 and 12 there are illustrated additional features of the present invention. A key advantage of the present invention is the ability to use portable roll formers in the field and manufacture on site roofing or building covering panels precisely to the length required and thereby to eliminate some of the seams and potential leaks. However, it is not possible to run a single panel the length of extremely long buildings and allow for thermal expansion. For this and other reasons the present invention provides for splicing panels or adding expansion joints.

FIGS. 11 and 12 illustrate an expansion joint referred to generally as 50. The distance 51 allowed between panels 40 is either figured from engineering principles for the materials or more commonly found by referring to tables provided by the manufacturer which list charts of linear expansion data for specific products. One component of the expansion joint is splice plate 52 which is configured to conform the lower surface of a roof panel 40, and to nest within the first side 41 of a panel and to interlock with the second side 45 of the panel and the anchor clips 43 used to hold the panels to the building or substrate.

An additional component of the expansion joint is furring strip 54 illustrated in cross section in FIG. 12. This helps support and reinforce the panels at the splice. The splice is waterproofed with fitted elastomeric seam seals as is consistent with other aspects of this invention or by other means known to those of skill in the art such as, by way of example and not limitation, applying beads of caulk. In the embodiment illustrated two continuous beads of caulk 55 would be applied along each side of the expansion joint parallel to the expansion gap 51.

USE OF THE INVENTION

Having described in detail component elements of the present invention, the manner of use of the invention will now be explained with reference to the accompanying drawings.

In the use and installation or operation of the new and improved structural building covering system and method and apparatus for moisture resistant seam assembly of the present invention, the following description will apply to the zee panel embodiment. Although various dimensions and specifications will be set out specifically for the purpose of this illustrative discussion, the invention is not be considered as limited to these specific dimensions, and it should be understood that component properties and dimensions can be varied greatly and still remain within the scope of the invention. A brief description of the use of the Bermuda panel embodiment will follow that of the zee panel.

A specific embodiment of the new structural standing seam roof panel would be fabricated on the previously mentioned manufacturing line of stampers, slitters, presses, dies and cutters. The roof panels as illustrated in FIG. 2 would be manufactured to a specific length designated by Fig. X. A single panel would have a 16″ exposure measured from the vertical upright panel 11 at the first side 2 of a given panel to the vertical upright plane 13 at the second side 3 of a given panel the overall height of the panel would be 2″ measured from the top of planes 12 or 14 to the bottom of plane 7. This would give a seam height of 2″ as will be more apparent as the following discussion is read and understood. The vertical rise from plane or element 7 to planes or elements 5 and 9 is ¼″ The width of plane or elements 5 and 9 measured at right angles to dimension X is 1 3/6″ The width of plane 14 measured at right angles to dimension X is 11/16″. The width of plane 12 measured in the same direction would be just slightly less than 11/16″, and the width of plane or element 15 measured transverse to dimension X would approximate 11/16″.

Proportions of a specific embodiment of the continuous "zee" rib, and of a "zee" clip (the only difference being the dimension X) are as follows:

Referring to FIG. 3, plane 22 would be approximately equal in width to plane 12 of the building panel illustrated in FIG. 2;

Plane 21, the vertical upright plane of the "zee" clip or "zee" rib is 2 ⅛″ in height;

The rise or vertical distance between planes 18 and 20 of the "zee" clip or continuous "zee" rib of FIG. 3 is approximately ⅜″, planes 17 and 19 are of equal width, and the horizontal distance measured from the vertical upright plane 21 across the face of bottom plane 20, and then the horizontal distance measured across planes 19, 18, and 17 is equal to 1 ⅜″.

The individual building covering panels, and ribs or clips described above and illustrated in FIGS. 2 and 3 would be manufactured in multiples so that a sufficient number of the 16″ exposure widths would be supplied to cover the wall, roof, or other surface of application. One continuous "zee" rib 16 (or sufficient number of "zee" clips), and one sealing means 35 is required for each interior seam location of the wall, roof, or other surface of application. These seam locations are indicated generally by numeral 1 in FIG. 6, as they occur whenever a first side 2 of a covering panel is positioned adjacent to the second side 3 of a next adjacent panel with the bracket "zee" clips or ribs interposed between during installation. A specific embodiment of the components thus far described comprising a roof panel section as illustrated in FIG. 2, a continuous "zee" rib bracket, or series of "zee" clips or brackets 16 as illustrated in FIG. 3 would be manufactured from 24 gauge galvanized steel.

The method or providing a moisture resistant structural roofing seam assembly of the present invention, and the use or operation of the new improved structural building covering system apparatus of the present invention begins with a fastening of the "zee" rib or a series of "zee" clips of FIG. 3 to the support (not shown) for the wall, roof, or other surface of application, or by the fastening of the zee clips or zee rib to decking or sheeting (also not shown) for the wall, roof, or other surface of application. The connection bracket clips or ribs may be optionally supplied with preformed openings 33 and 34 which can be used for fastening bearing plates to the surface of application.

Next, the roofing panels as illustrated in FIG. 2 are installed. This is done by moving the first edge 2 of a giving building panel adjacent to an installed connection bracket "zee" clip rib or an installed series of "zee" clips so that plane 11 of the panel as illustrated in FIG. 2 lies adjacent to the upright plane 21 of the "zee" clip rib 16 and so that plane 12 of the building panel lies adjacent to and underneath plane 22 of the "zee" clip ribs (or series of "zee" clips). This installation may be facilitated by rolling or rotating the panel illustrated in FIG. 2 in a counter clockwise direction relative to the illustration in FIG. 2 so as to roll planes 11 and 12 in and up to rest adjacent to and underneath planes 21 and 22 respectively.

Figure 5:
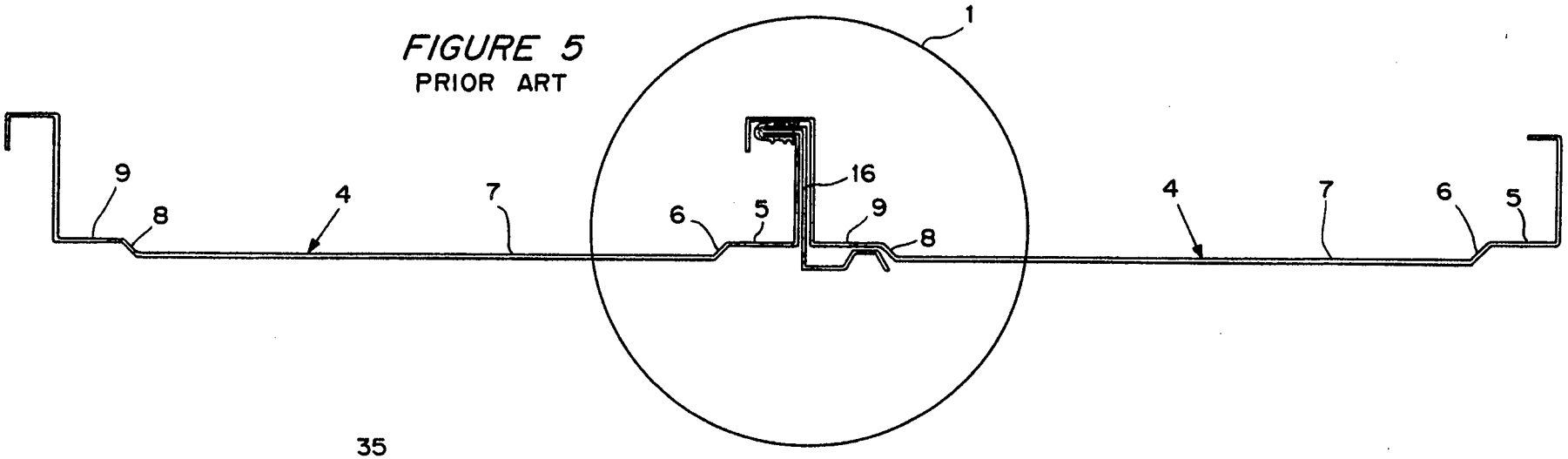
FIGURE 5 PRIOR ART
FIG. 5 is an elevational sectional view of two roofing panels other component parts presenting an assembled moisture resistant seam assembly in profile; and, FIG. 6 is a perspective view of a coil of the elongate sealing member for use within the moisture resistant seam assembly of the present invention.

The next step, assuming that a moisture resistant seam is required for the particular application, is to install the sealing element 35 illustrated in FIGS. 4 and 6 as illustrated in FIG. 6, the sealing element may be supplied in a roll or reel and clipped or cut to the length consistent with dimension X for any given building covering application. This sealing element 35 can be installed by hand by simply uncoiling the required length and cutting it off, and then pressing the sealing element onto the combined thicknesses of planes 12 and 22 by sliding the sealing element over the combined thicknesses of 12 and 22 so that planes 12 and 22 fit into the interior 38 of the sealing element (FIG. 4). FIGS. 5 and 1 clearly illustrate the sealing element in position over the two horizontal facing planes 12 and 22. Although it is a simple matter to place this sealing element 35 over the two mating horizontal flanges or planes 12 and 22 by hand, it is envisioned that a simple combination rolling guide tool can be supplied to further speed up the installation of the weather stripping member. This tool could utilize a gauge to position the strip the correct distance above the bottom panel 4, and a holder for a coil of sealing strip, and some type of guide to guide the weather strip sealing element 35 from the coil, and to press it into position against and over the mating flanges or planes 12 and 22.

Referring now to FIG. 5, it should be understood that the previous described method of use has essentially gone through the installation of half of the two panel assembly illustrated in FIG. 5. In effect, the left panel 40, of FIG. 5 has been put into position. The next step, after the step of installing the sealing element 35, is to put into position the right half of the two panel assembly of FIG. 5. This is done by repeating the above procedure so that the first side 2 of panel 41, which is to the right of panel 40, is rolled to rotated into position under the next adjacent panel (not shown) to the right of panel 41 as presented by the view of FIG. 5. With the understanding that it is one possible method of installation to install every zee rib required for a given installation, prior to installation of the remaining components, and with the understanding that it is necessary to install the "zee" clips in series or "zee" ribs prior to the installation of the panels themselves, it is apparent that the first side 2 of the panel 41 would be rotated into position underneath plane 22 and adjacent to plane 21 of the next row (not shown) of "zee" clips 16 to the right of the seam designated by numeral 1 in FIG. 5. After the first side 2 of panel 41 is put into position, the second side 3 of panel 41 would be rotated down to rest on top of the combination of the sealing element 35, and planes 22 and 12 of the continuous "zee" rib 16 and the first side 2 of panel 40 respectively. As is apparent from a study of FIG. 1 the bottom side or surface of the element or plane 14 of panel 41 will be directly adjacent the upper leg of the U of the sealing member 35. As is also apparent from a study of FIG. 1, the interior portion of plane 15 will be directly adjacent or resting against the rounded closed portion of sealing element 35. At this point the importance of the extensions of the ridges or flaps 37 can best be understood. The additional ridges or flaps 37 are especially important where a series of "zee" clips 16 is used rather than a continuous "zee" rib. In these cases greater elastomeric qualities are desirable in that along a seam, the sealing element must seal at some portions only against plane 12 and at other portions against the combined thicknesses of planes 12 and 22, in as much as the clips are located at intervals. The fingers or ridges 37 along the exterior surface of the sealing element 35 will engage the interior portions of plane 14 and 15 to provide more effective moisture proof barrier, and in effect, a redundancy of barriers against the migration of moisture. The manner of multiple seal arrangement is effectuated. Though the drawings depict a preferred usage of four pliant ridges 37, different numbers of ridges may be used without departing from the spirit of this disclosure.

A final step remains in the assembly or method of use and operation of the present invention in that once a panel, designated as panel 4 in FIG. 5 has been rotated so that its second extending plane [and three] rests along the top of the seam assembly 1 directly on top of the sealing element 35, it is then necessary to fold, crimp, or clamp plane 15 into its final position substantially parallel to plane 14 as illustrated in FIG. 1. In FIG. 1 the dotted line of plane 15 illustrates the beginning position, and the solid line of plane 15 illustrates the position after the seam assembly has been closed. This closure is accomplished by running a roller crimping tool along the length of the seam assembly to roll the plane or flange 15 into the finished position as is shown in FIG. 1. The roller clamps, the elastomeric seal 35 between planes 14 and 15 of the second side 3 of any given roofing panel, such as panel 41 of FIG. 6 with planes 12 and 22 of an adjacent roofing panel and a "zee" rib or "zee" clip interposed between the legs of the U of the elastomeric seal number 35. Thus clamped into position the combination of elements or flanges 15, 12, 22 and 14 act much as the flanges on an I-beam and provide substantial structural strength along the seam of the building covering assembly. In addition, the clamping of flanges 14 and 15 around and about the seal element 35, and about the flanges or elements 12 and 22 within the interior 38 of the seal providing a moisture resistant seam assembly with great ease of assembly, and further provides a weather resistance not found in the prior art of structural building covering components. The moisture resistant seam further of the present invention prevents any capillary syphoning action of standing water in to the elongate seam.

A specific embodiment of the new and improved Bermuda panel roof panel and seam would be fabricated on the previously mentioned manufacturing line of stampers, slitters, presses, dies and cutters from a continuous coil width of 14" nominal, 13 $\frac{7}{8}$" actual. The roof panels as illustrated in FIG. 7 would be made to a specific length as designated by X. A single panel would have an 11" exposure measured from the outside of the first side 44 to the edge of the receptacle pocket at 45. This is illustrated as Z in FIGS. 7 and 8. The length of the return or male leg 46 at the first side of the panel 44 is 9/16", dimension m in FIG. 8. The overall depth of the receptacle pocket is 9/16", dimension O, FIG. 8. The pocket narrows to an interior open width of $\frac{1}{8}$", dimension i, FIG. 8. The length of the flare of the pocket opening from the narrow portion is $\frac{3}{8}$", dimension f, FIG. 8. The Bermuda panel has a 1" butt line, dimension b, FIG. 8, and when formed from 24 gauge material will provide full length or very long panels for stepped smooth horizontal lines on a roof similar to the concrete roofs in Bermuda and Florida without requiring stepped sheathing and numerous splices.

Figure 8B:
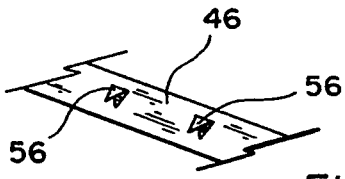
FIG. 8B is a perspective of a detail of seal retaining offsets on a panel leg.

The Bermuda panels are fitted with the elastomeric seam seal 35 for applications where complete air and water tightness is required. Means is provided for securing the seam seal 35 to the male leg 46. For example, the male leg of the panels may be pierced and offset during the roll forming process to provide a retaining spur 56 that will secure the seam seal 35 which is applied to the panel edge from a spool of continuous strip which is attached to the roll former during fabrication. See FIGS. 8A and 8B. Other variations are apparent, such as piercing and offsetting the male leg 46 during roll forming to provide a protrusion 56 that would interlock with specially designed protrusions of the elastomeric insert. Alternatively as in FIGS. 13 and 14, a button 57 could be formed at intervals along the inside of the insert 35 that would mate with perforations or openings made at matching intervals along the male leg 46. These and other variations are to be considered within the scope of the invention. In particular U.S. Pat. No. 4,641,475 previously referenced discloses an elastomeric seam seal insert configuration that can be adapted for use with the present invention.

The method of using the Bermuda panels of the present invention begins with installing a series of anchor clips along the eave of a roof. Next the first side 44 of a panel, preferably fabricated on site to the exact length required, is fitted under the clip, the panel is pulled 'upslope' or toward the ridge to seat the seam seal on the male leg of the first panel, and then the second side of the first panel is secured to the building or substrate by a second series of anchor clips 43. The number and spacing of the anchor clips can be varied, and designed for specific applications, but for the embodiment herein disclosed would be spaced 20" on center. The first side of a second panel is next fitted and seated into the receptacle pocket at the second side of the first panel and then the second side of the second panel is secured by a third series of anchor clips. Thus it is seen that the anchor clips serve both to secure the panels to the building or substrate and to interlock the adjacent panels together and retain the seam seal within its seat. In similar fashion panels are fabricated to fit, and installed in sequence from eave to ridge until the roof is covered.

The foregoing disclosure and description of the invention are illustrative and explanatory thereof, and various changes in the size, shape and materials, as well as the details of the illustrated construction may be made without departing from the spirit of the invention.

Therefore I claim:

1. An improved structural building covering assembly comprising:

(a) a plurality of panels, each comprising a first and second edge and an interior pane, said panels positionable in side by side relationship wherein a first edge of any given panel will lie adjacent to a second edge of a panel installed adjacent to said given panel, wherein each said first edge comprises a lip directed relatively towards the interior pane of its respective panel; and wherein each said second edge comprises a receptacle pocket segment and a flared lip segment, said receptacle pocket segment oriented with a slot directed relatively toward the interior pane of its respective panel for receiving the lip at the first edge of an adjacent panel so that adjacent panels will be interlockingly interconnected;

(b) sealing means comprising a member which is "U" shaped in cross section and which is fitted over said lip at said first edge of said panels and extended continuously for the length of said panels so that said sealing means will isolated and be interposed between, said lip at the first edge of a given panel from said receptacle pocket of the second edge of an adjacent panel, and so that said sealing means is spaced apart from said flared lip segment at said second edges, when adjacent panels are assembled; and, (c) clip means for securing said panels to a building without breaking said sealing means, comprising means for interconnection of said clip means with said flared lip segments at said second edges of said panels and means for attachment of said clip means to a building.

2. The invention of claim 1 wherein said sealing means comprises an extruded elastomeric member.

3. The invention of claim 1 wherein said sealing means comprises an extruded member.

4. The invention of claim 1 further comprising means for securing said sealing means to said first edge of said panels.

5. An improved structural building covering assembly comprising:

(a) a plurality of panels, each comprising a first and second edge and an interior pane, said panels positionable in side by side relationship wherein a first edge of any given panel will lie adjacent to a second edge of a panel installed adjacent to said given panel, wherein each said first edge panel comprises a lip directed relatively towards the interior pane of its respective panel; and wherein each said second edge comprises a receptacle pocket segment and a flared lip segment, said receptacle pocket segment oriented with a slot directed relatively toward the interior pane of its respective panel for receiving the lip at the first edge of an adjacent panel so that adjacent panels will be interlockingly interconnected;

(b) sealing means comprising a member which is "U" shaped in cross section and which is fitted over said lip at said first edge of said panels and extended continuously for the length of said panels so that said sealing means will isolated and be interposed between said lip at the first edge of a given panel from said receptacle pocket of the second edge of an adjacent panel, and so that said sealing means is spaced apart from said flared lip segment at said second edges, when adjacent panels are assembled;

(c) clip means for securing said panels to a building without breaking said sealing means, comprising means for interconnection of said clip means with said flared lip segments at said second edges of said panels and means for attachment of said clip means to a building: and, (d) means for securing said sealing means to said first edge of said panels comprising offset perforations along said first edge of said panels.

6. The invention of claim 5 wherein said sealing means comprises an extruded elastomeric member formed with protrusions matching the perforations along each said first edge wherein said protrusions interconnect with said perforations to hold said sealing member to said first edges.

7. The invention of claim 2 wherein said sealing means further comprises a plurality of pliant ridges formed generally with and extending from the exterior surface of the "U" shape of said sealing means.

8. The invention of claim 2 wherein said sealing means further comprises a plurality of pliant ridges formed generally with and extending from the interior surface of the "U" shape of said sealing means.

9. The invention of claim 4 wherein said means for securing said sealing means comprises openings formed along said first edge of said panels and wherein said sealing means comprises an extruded elastomeric member formed with protrusions matching the openings along each said first edge wherein said protrusions interconnect to hold said sealing member to first edges.

10. The invention of claim 4 wherein said sealing means comprises an extruded elastomeric member.

11. The invention of claim 4 wherein said sealing means comprises an extruded member.

12. The invention of claim 5 wherein said sealing means further comprises a plurality of pliant ridges formed generally with and extending from the exterior surface of said sealing means.

13. The invention of claim 6 wherein said sealing means further comprises a plurality of pliant ridges formed generally with and extending from the exterior surface of said sealing means.

* * * * *